United States Patent [19]

Gomez

[11] 4,214,318

[45] Jul. 29, 1980

[54] PORTABLE ROLL-UP BUG NETTING EMPLOYING INTEGRAL STORAGE ENVELOPE

[76] Inventor: Manuel D. Gomez, 935 E. Morning Star, Tempe, Ariz. 85283

[21] Appl. No.: 40,731

[22] Filed: May 21, 1979

[51] Int. Cl.[3] ..... A42B 3/00; A42B 5/00

[52] U.S. Cl. ..... 2/4; 2/209.1

[58] Field of Search ..... 2/4, 196, 202, 205, 2/206, 209.1, 185 R

[56] References Cited

U.S. PATENT DOCUMENTS

| | | | |
|---|---|---|---|
| 336,712 | 2/1886 | Garst | 2/4 |
| 2,694,812 | 11/1954 | Neuburger | 2/209.1 |
| 2,835,899 | 5/1958 | Monro et al. | 2/202 |
| 4,032,991 | 7/1977 | Vandeweghe | 2/206 X |

OTHER PUBLICATIONS

Gershman, "Self Adhering Nylon Tapes", 10-18-58, J.A.M.A., vol. 68, No. 7, p. 930.

*Primary Examiner*—Peter P. Nerbun
*Attorney, Agent, or Firm*—Warren F. B. Lindsley

[57] ABSTRACT

A portable roll-up bug netting for fitting over and tightly embracing hat crowns of different diameters and around the collar or neck of the user and embodying an integral predetermined positioned storage envelope into which the rolled-up bug netting is inserted for storage.

2 Claims, 8 Drawing Figures

PORTABLE ROLL-UP BUG NETTING EMPLOYING INTEGRAL STORAGE ENVELOPE

BACKGROUND OF THE INVENTION

This invention relates to portable head screens or netting adapted to be slipped over the hat of the wearer so as to protect his head from mosquitos or similar insects. Heretofore, head screens have been known but none has been particularly designed to be easily rolled or folded up into an integral storage packet or envelope forming a part of the device.

DESCRIPTION OF THE PRIOR ART

U.S. Pat. No. 336,712 discloses a head screen consisting of an elastic or non-elastic band at its upper edge, an elastic or non-elastic band at a little distance from its lower edge, and a flexible series of weights along its lower edge.

U.S. Pat. No. 473,599 discloses a portable mosquito-net adapted to be slipped over the hat to protect the head of the wearer.

U.S. Pat. No. 876,452 discloses a head screen comprising a cap having a flaring semi-rigid visor around its lower edge, a concave-convex wire face protector connected to and depending from the cap, and a two part mosquito netting connected to a suitable binding secured to the edges of the face mask.

U.S. Pat. No. 3,582,989 discloses a bee-keepers suit having an upstanding collar and a veil having a hole through which the head is inserted. The hole is surrounded by an elastic band and the exterior of the collar carries a downwardly-facing ledge beneath which the elastic band engages to form a closure between the veil and suit collar. The ledge may be a strip of foamed material secured to the collar by a Velcro fastener.

None of the above patents disclose a head protector which may be easily rolled up and stored in its integral packet or envelope so that it may be carried by an outdoorsman and easily used when needed.

SUMMARY OF THE INVENTION

In accordance with the invention claimed, a new and improved head screen for the outdoor enthusiast is provided which is so conceived and designed that it may be easily rolled or folded up on itself and stored in a packet or envelope forming an integral part thereof while still fitting on or to a variety of caps of the wearers.

It is, therefore, one object of this invention to provide a new and improved portable head screen for attaching to the hat of the wearer.

Another object of this invention is to provide a new and improved portable head screen that embodies an integral packet or envelope for storing the head screen when not in use.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
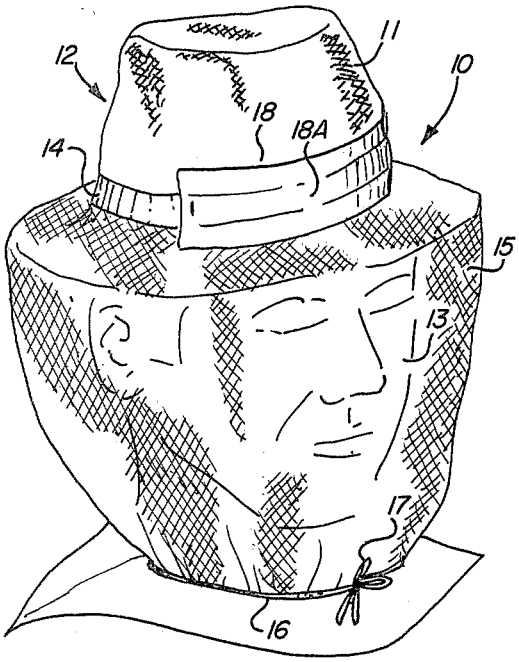
FIG. 1 is a perspective view of the head screen device mounted on a wearer and embodying the invention.
Figure 2:
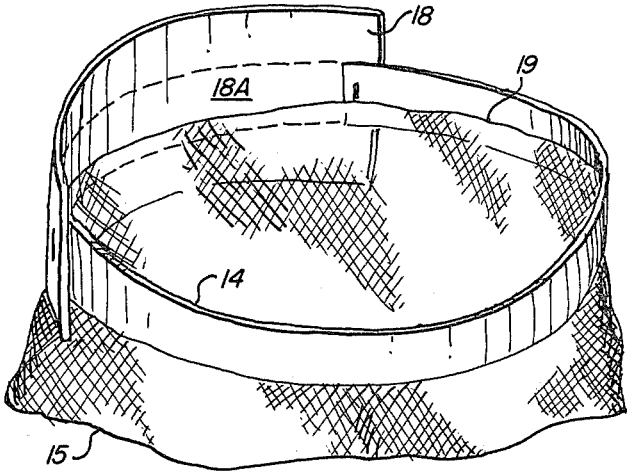
FIG. 2 is an enlarged perspective view showing the hat engaging rim of the device in its expanded condition and the integral packet or storage envelope of the device.
Figure 3:
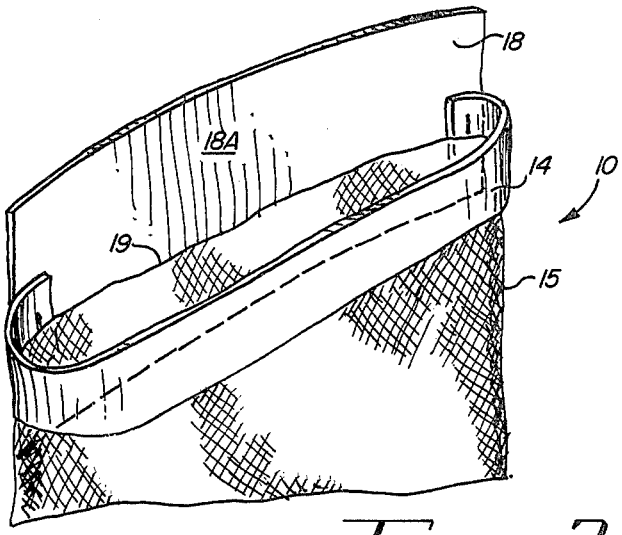
FIG. 3 is an enlarged perspective view similar to that shown in FIG. 2 of the hat engaging rim of the device in its contracted position.

Referring more particularly to the drawing by characters of reference, FIG. 1 discloses a single piece head screen or device 10 for fitting around the crown 11 of a hat 12 of a wearer 13. The device comprises an elastic band 14 at its upper edge which is intended to be expanded as shown in FIG. 2 and then placed around the crown 11 of the cap or hat 12 of the wearer where it is permitted to contract to snugly fit thereon. The cap or hat 12 may be of substantially any style or material and may or may not have a rim or visor and still satisfactorily support the device claimed.

The mask or head protector 15 of device 10 comprises a fine mesh screen formed of a plastic material which may be easily and repetitively rolled or folded up without damaging the mesh size or material from which it is formed.

A suitable binding 16 may be placed around the lower edge of the mesh material with a tie string 17 loosely fitting into the binding which may be pulled to gather the binding tightly around the neck of the wearer in the usual manner to prevent insects from getting under the netting.

In accordance with the teachings of this invention, an envelope or packet 18 is attached to the upper edge 19 of netting 15 to form an integral part of device 10. This packet forms a storage covering for the other parts of device 10 when it is not in use. The packet is formed of a pliable piece of flat material 18A which may be easily folded along the fold lines 20 and 21 to readily receive in its later formed packet interior the netting 15 of the device.

Figure 4:
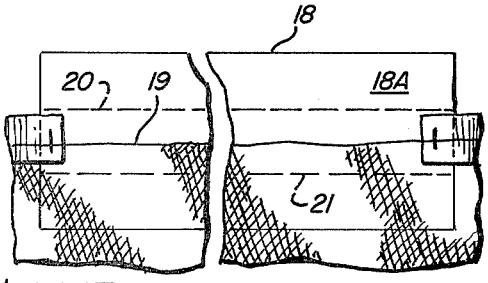
FIG. 4 is a partial plan view of the back of the device shown in FIGS. 2 and 3 illustrating the fold lines of the packet.
Figure 5:
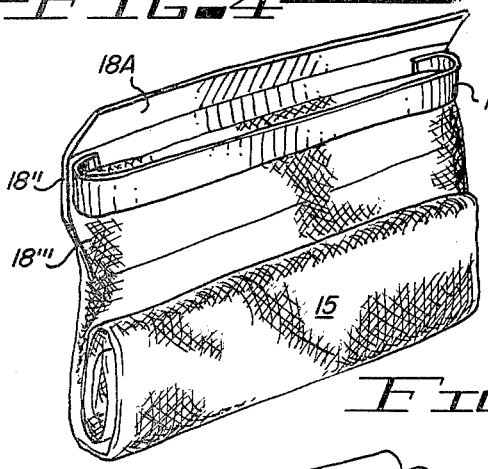
FIG. 5 is a perspective view of the head screen device shown in FIGS. 1–4 in partially rolled up condition.

As shown in FIGS. 4 and 5, material 18A of the packet 18 forms a wide band at the top of the netting against and over which the netting 15 may be rolled or folded in the manner shown in FIG. 5. To fold the netting for storage, it is first folded over onto itself longitudinally thereof until it has a width substantially the width of material 18A. The material of the netting is then folded longitudinally of itself in the manner shown in FIG. 5 until it folds up and lies over material 18A.

Figure 6:
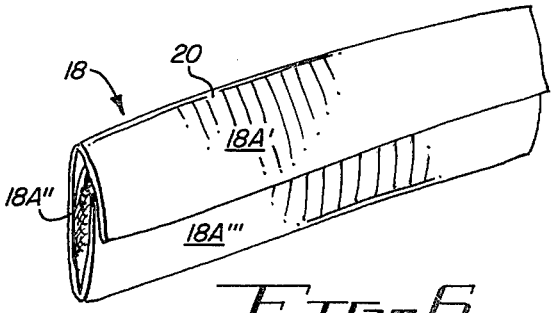
FIG. 6 is a perspective view of the head screen device shown in FIG. 5 in its stored condition with the device in its integral storing packet.

FIG. 6 illustrates that when the netting is folded over onto itself the three parts 18A', 18A'' and 18A''' form a packet or open ended envelope which surrounds the netting to protect it from being destroyed by other items such as fishing gear if the packet is stored in a fishing box.

Figure 7:
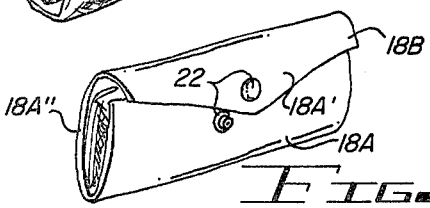
FIG. 7 is a perspective view similar to FIG. 6 showing a snap closure for the packet.

FIG. 7 illustrates that a known snap clasp 22 may be used to keep the packet closed. As shown in FIG. 7, the portion 18' of the packet material may have its edges trimmed off to form an envelope-like flap 18B.

Figure 8:
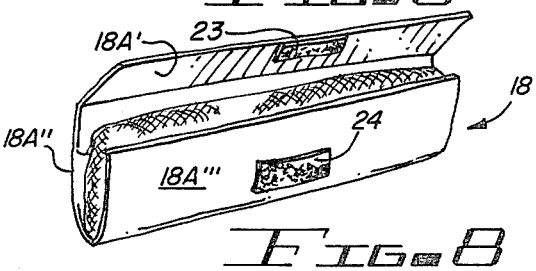
FIG. 8 is a perspective view similar to FIGS. 6 and 7 illustrating that the packet may be closed by a Velcro fastener.

FIG. 8 illustrates that the packet 18 shown in FIG. 6 may be detachably closed by the use of a Velcro connector comprising its engaging parts 23 and 24 mounted on the inside surfaces of part 18A and the outside surface of part 18A'''.

Thus, an inexpensive portable collapsible head screen is disclosed which comprises a flat piece of material forming a band partially surrounding the crown of the hat when in use. When the device is collapsed and rolled up the material forms the parts of the packet which surrounds and holds the device in a storage condition.

What is claimed is:

1. A head screen comprising:

a protective veil formed of an open-ended cylindrical like small mesh plastic screening having a mesh size which prohibits mosquitos from passing therethrough, an elastic band formed around one end of said screening, said band being positionable around the crown of a hat of a user, a tie string being mounted around the other end of said screening for snugly fastening said other end around the neck of the user, a strip of pliable material attached to said band at said one end to extend outwardly of said band and inwardly thereof over a part of said band and said screening, said material being provided with spaced fold lines extending longitudinally of its length for aiding in folding it over on itself with the veil folded and lying along one of its surfaces, whereby when said screening is folded laterally thereof to the length of said material and then longitudinally thereof to lie over at least a part of said material, said material then may be folded over said screening along said fold lines to form an overlapping covering therefor, and a fastening means secured to another side of said material for detachably interconnecting the overlapped portions of said material to form a packet for said veil.

2. The head screen set forth in claim 1 wherein:

said material is formed integral with said band and said one end of said screening.

* * * * *